United States Patent [19]

Mariani

[11] Patent Number: 4,971,025

[45] Date of Patent: Nov. 20, 1990

[54] GAS-POWERED APPARATUS FOR PRODUCING WARM WATER AND FOR HEATING AN ENCLOSED SPACE

[75] Inventor: Mario Mariani, Cesena, Italy

[73] Assignee: ATI di Mariani Mario & C. S.n.c., Cesena, Italy

[21] Appl. No.: 450,498

[22] Filed: Dec. 14, 1989

[30] Foreign Application Priority Data

Dec. 23, 1988 [IT] Italy ..... 4987/88[U]

[51] Int. Cl.[5] ..... F24D 9/00

[52] U.S. Cl. ..... 126/101; 126/85 B; 126/365; 122/20 B; 122/44 A; 122/155 A

[58] Field of Search ..... 126/101, 365, 307 R, 126/312, 85 R, 85 B, 80, 365; 237/19, 12.3 C, 12.3 A; 122/20 A, 22, 20 B, 44 A, 44 B, 155 A, 155 C; 431/247

[56] References Cited

U.S. PATENT DOCUMENTS

| | | | |
|---|---|---|---|
| 966,064 | 8/1910 | Wallace | 126/101 |
| 3,272,197 | 9/1966 | Gordon | 126/307 R |
| 4,192,457 | 3/1980 | Easterly | 126/101 |
| 4,662,350 | 5/1987 | Mossbach | 126/101 |

*Primary Examiner*—James C. Yeung

*Attorney, Agent, or Firm*—Albert Josif; Guido Modiano

[57] ABSTRACT

This gas-powered apparatus comprises a substantially cylindrical combustion chamber having an inlet for the combustion air connected to the outside and an upper outlet connected to a burned gas flue. A tank is arranged around the combustion chamber and defines therewith an interspace, so that the water in the tank can be heated substantially by radiation. The interspace is downwardly connected to a duct having an opening for a fan sucking air from the enclosed space through the interspace and returning it to the enclosed space.

1 Claim, 1 Drawing Sheet

GAS-POWERED APPARATUS FOR PRODUCING WARM WATER AND FOR HEATING AN ENCLOSED SPACE

BACKGROUND OF THE INVENTION

The present invention relates to an apparatus for producing warm water and for heating an enclosed space.

Two separate devices are usually provided to heat enclosed spaces and to produce warm water. For example, in the case of small enclosed spaces such as caravans, motorhomes and the like, the heating is provided by an electric or gas-powered stove, and the warm water is produced by an electric or gas-powered heater.

The duplication of said devices obviously entails a wasteful use of materials, installation times and space which is not always available in small enclosed spaces.

SUMMARY OF THE INVENTION

The aim of the present invention is therefore to provide an apparatus capable of meeting the two requirements of heating and warm water production.

Within the scope of this aim, an object of the invention is to provide an apparatus which allows a certain flexibility in use in relation to the possibility of creating a certain ventilation of the enclosed space in which it is installed.

This aim and this object are achieved by an apparatus as defined in claim 1.

BRIEF DESCRIPTION OF THE DRAWINGS

The characteristics and advantages of the present invention will become apparent from the following detailed description of a preferred embodiment, illustrated only by way of non-limitative example in the accompanying drawings, wherein.

DESCRIPTION OF THE PREFERRED EMBODIMENTS

Figure 1:
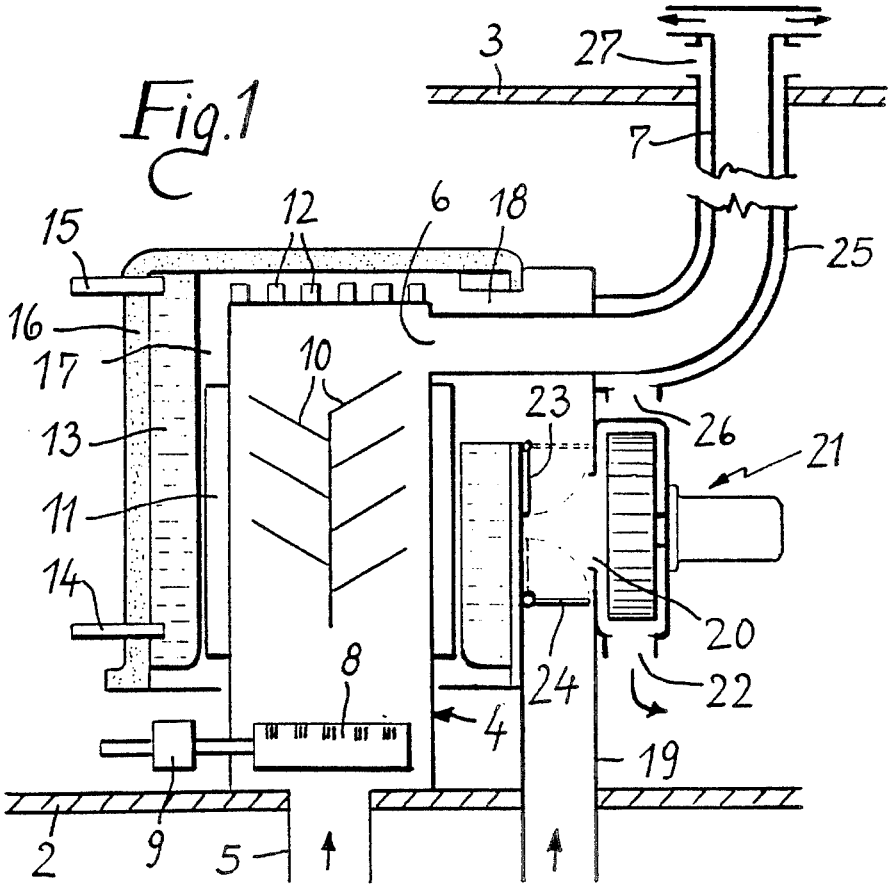
FIG. 1 is a schematic vertical sectional view of the apparatus according to the invention.
Figure 2:
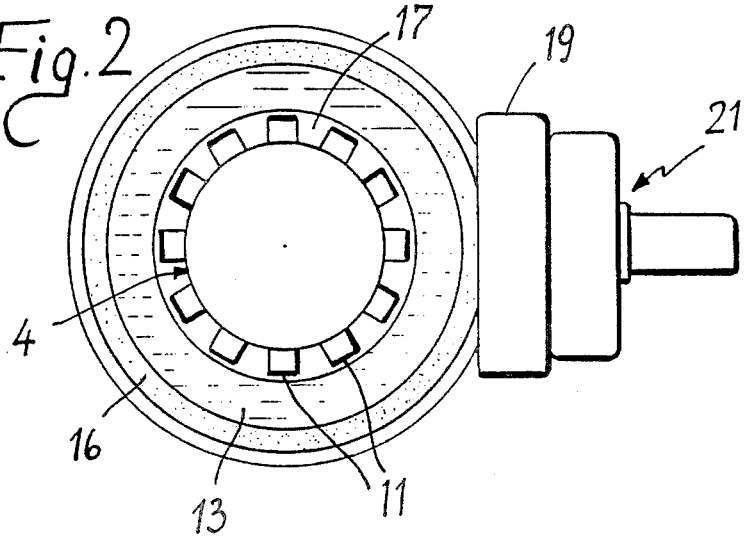
FIG. 2 is a plan view of said apparatus.

With reference to the above figures, the reference numeral 1 generally indicates the apparatus. In the illustrated example, said apparatus is assumed to be installed in a caravan or motor-home, the floor and ceiling whereof are indicated at 2 and 3 respectively.

The apparatus comprises a cylindrical combustion chamber 4 which is downwardly provided with an inlet 5 for the combustion air and is upwardly provided with an outlet 6 for the burned gases.

The inlet 5 is directly connected to the outside through the floor 2, and the outlet 6 leads into a flue 7 for discharging the burned gases. Said flue 7 conveniently leads outside through the ceiling 3.

A burner 8 is arranged in the lower portion of the chamber 4 and is connected to the gas delivery through a valve assembly 9. Baffles 10 are arranged inside the combustion chamber 4, and a set of fins 11, including evenly spaced vertical fins is provided on the outer periphery. A further set of fins 12 is arranged at the top of the combustion chamber.

A water tank extends around the combustion chamber 4 and has an annular cylindrical configuration. Said tank, indicated at 13, is provided with an inlet connection 14 and an outlet connection 15 for the water and is externally covered with an insulating layer 16 adapted to reduce outward thermal dispersion.

An interspace 17 is defined between the inner wall of the tank 13 and the outer wall of the combustion chamber 4 and also embraces the top of said chamber. The interspace 17 is downwardly connected to the enclosed space of the caravan or motor-home and is upwardly connected to a duct 19 through an opening 18 of the tank.

Said duct 19 extends downwards to the side of the thermally insulating layer 16 and is connected to the outside through the floor 2.

An opening 20 is provided along the duct 19, and a fan 21 is mounted thereat.

Said fan 21 sucks air through the opening 20 and introduces it inside the caravan or motor-home through the outlet 22. The air introduced into the motor-home can be sucked directly from the outside through the duct 19 or sucked from the inside through the interspace 17. Two butterfly valves 23, 24 are provided for this purpose and are alternately placed in cutoff position depending on whether warm air or ventilation air is to be conveyed into the enclosed space.

When the valve 23 is in cutoff position, the valve 24 is in fact in open position (as shown with dashed line in FIG. 1), allowing the fan 21 to suck fresh air in from the outside and therefore to ventilate the enclosed space. Vice versa, when the valve 24 is in closed position, the valve 23 is open (as shown with continuous line), so that air which has been preheated by passing through the interspace 17 is introduced into the enclosed space.

The operation of the apparatus according to the invention is fully intuitive on the basis of the above description.

In particular it should be noted that the apparatus is capable of performing three functions: heating the enclosed space, producing warm water and ventilating the enclosed space regardless of whether the heating is activated or not.

A substantial prerogative of the present invention is constituted by the fact that the water tank surrounds the combustion chamber with the interposition of said interspace.

In this manner, the effective heating of the water is allowed by radiation and by employing the convective motions of the heating air, in particular as regards the upper portion. The heating of the water is advantageously facilitated by the increase in the radiating surface determined by the sets of fins 11 and 12.

In an advantageous different embodiment of the invention, a tube 25 is arranged coaxially around the flue 7 and has an opening 26 proximate to the duct 19, i.e. internal to the enclosed space, and an opening 27 external to the enclosed space. The tube 25 encloses, together with the flue 7, an interspace which allows any gas leakages escaping from the flue 7 to be conveyed out of the enclosed space.

In the practical embodiment of the invention, the shapes and dimensions may be any according to the requirements. For example, the same innovative concept can be used to provide an apparatus which is wall-mounted instead of floor-mounted.

What is claimed:

1. A gas-powered apparatus for producing warm water and for heating an enclosed space comprising;

a cylindrical combustion chamber, an air inlet communicating with said combustion chamber and with an outside space, a flue for burned gases, an upper outlet communicating with said combustion chamber and with said flue for burned gases, a water tank arranged around said combustion chamber at a distance therefrom, a duct, an interspace defined between said combustion chamber and said water tank whereby to allow water contained in said water tank to be heated substantially by radiation by said combustion chamber, said interspace downwardly communicating with an enclosed space to be heated and upwardly communicating with said duct, an opening defined in said duct, a fan arranged at said opening whereby to suck air from said enclosed space and through said interspace and to return sucked air to said enclosed space, wherein said duct is connected to said outside space, and wherein said apparatus further comprises two valves, one of said two valves being arranged upstream of said opening, another of said two valves being arranged downstream of said opening, said valves being alternately actuatable in a duct cutoff position, whereby to selectively convey into said enclosed space air from said interspace and air from said outside space.

* * * * *